United States Patent [19]

Clark

[11] 4,316,302

[45] Feb. 23, 1982

[54] TROWEL

[76] Inventor: Ronald M. Clark, 105 Factory, Addison, Ill. 60101

[21] Appl. No.: 130,469

[22] Filed: Mar. 14, 1980

[51] Int. Cl.[3] ..... B05C 17/10

[52] U.S. Cl. ..... 15/235.4; 15/245

[58] Field of Search ..... 15/105, 105.5, 235.4, 15/235.5, 235.6, 235.7, 235.8, 245; 366/129

[56] References Cited

U.S. PATENT DOCUMENTS 2,952,028 9/1960 Robbins ..... 15/235.4
3,101,502 8/1963 Levy ..... 15/235.4
3,166,776 1/1965 Selck ..... 15/235.6
3,341,878 9/1967 Hubbard ..... 15/235.4

FOREIGN PATENT DOCUMENTS 2421251 11/1979 France ..... 15/235.4

*Primary Examiner*—Chris K. Moore
*Attorney, Agent, or Firm*—Robert F. Van Epps

[57] ABSTRACT

An improved trowel for the spreading of adhesives, plaster and the like having a blade and an integrally formed handle particularly adapted for manufacture by injection molding a thermoplastic material.

9 Claims, 5 Drawing Figures

TROWEL

BACKGROUND OF THE INVENTION

1. Field of the Invention

The present invention relates most generally to the field of hand tools and more particularly to trowels for spreading and/or smoothing adhesives, plaster and the like.

2. Description of the Prior Art

Prior to the present invention a large variety of specialized trowels were produced for spreading various adhesives, plaster, and the like on floors and walls. Trowels for adhesives generally were made of a rectangular metal blade having variously configured serrations on one side and one end thus requiring both right and left hand models to be produced. Trowels for smoothing plaster, cement and like substances were of a similar configuration but with smooth edges. Trowels for grouting floor and wall tile were rectangular in shape and included a rubber or sponge pad on the blade. The prior art trowels have handles which are assembled to the blades by welding or riveting and are typically of a cantilever construction although an inverted u-shaped handle is also known.

A number of deficiencies have become evident with the prior art trowels. The requirement of both right and left hand model adhesive trowels made production and distribution inefficient. The typical cantilever handle and metal blade were susceptible to bending under downward pressure unless of heavy construction which increased the weight and expense of the tool. The metal construction was further subject to deterioration by rust and attack by corrosive substances.

OBJECTS AND SUMMARY OF THE INVENTION

From the foregoing discussion it will be understood that among the various objectives of the present invention are:

- to provide a new and improved hand trowel;
- to provide apparatus of the above-described character wherein the handle and blade are formed as a single piece;
- to provide apparatus of the above-described character formed of a resilient thermoplastic material; and
- to provide apparatus of the above-described character which is usable in both the right and left hand.

These and other objectives of the present invention are efficiently achieved by providing a blade and arcuate handle integrally formed of a resilient thermoplastic material. The blade is formed with a centrally disposed elongate aperture into which a rigid insert plate is assembled flush with the bottom surface. Both the blade and handle portions are provided with longitudinal ridges to provide structural integrity. In one embodiment the blade portion is of a trapezoidal configuration such as to be usable in both the right and left hand. In other embodiments a rectangular blade configuration may be used alone to smooth surfaces or in conjunction with a disposable pad for grouting tile.

The foregoing as well as other objects, features and advantages of the present invention will become more apparent from the following detailed description taken in conjunction with the appended drawings.

DESCRIPTION OF PREFERRED EMBODIMENT

Figure 1:
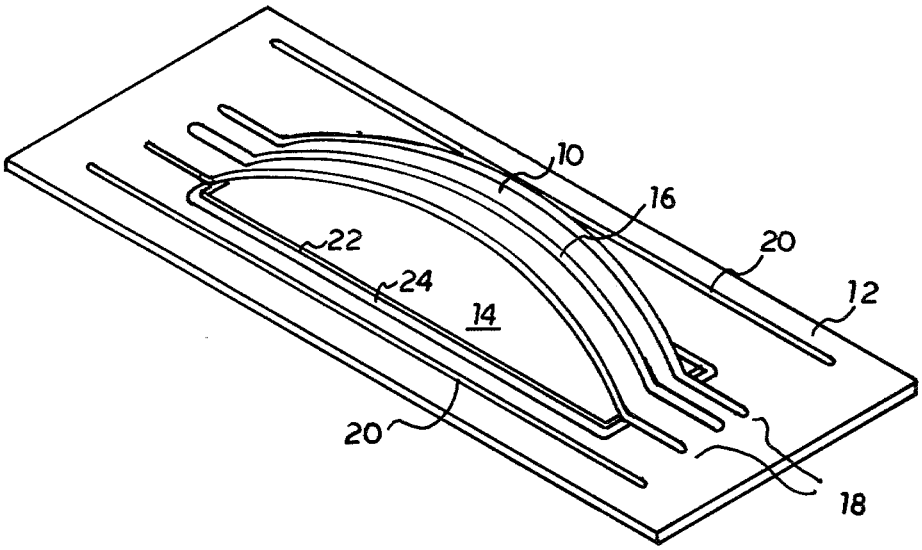
FIG. 1 is a perspective view of a plastering trowel in accordance with the principles of the present invention.

With reference now to FIG. 1 there is shown in perspective a plastering trowel withn the contemplation of this invention. The handle 10 and blade 12 are formed as a unitary structure preferably of a resilient thermoplastic material by injection molding techniques which are well known. The molded handle and blade structure is assembled with a rigid insert plate 14.

While the use of the insert plate 14 is not essential to the invention its use is desirable in several respects; first, it adds strength to the assembly; second, it protects the user's hand from the material being troweled and third, it provides a surface on which information such as advertising, instructions and the like may be placed by various techniques such as heat stamping, silk screening, adhesive labels or painting.

The applicant has found a wide variety of thermoplastic materials which are useful in the practice of his invention and in particular high impact styrene has been found to have adequate strength while being economical. This material being available in many colors permits color coding of various trowels according to their use.

The shape of the handle 10, being an arc, is inherently resistant to downward pressure, however, it has been found that the addition of reinforcing ridges 16 and 18 not only provide increased structural integrity but also provide a more comfortable grip for the user. In the preferred embodiment a primary reinforcing ridge 16 is formed substantially along the centerline of the handle 10 and extends beyond the end thereof onto the upper surface of the blade 12. Secondary reinforcing ridges 18 formed along the edges of handle 10 and onto the upper surface of blade 12 provide even greater structural strength and also provide a rounded edge for greater comfort for the user. It has also been found that in the injection molding process the ridges 18 act as runners for the flow of the thermoplastic material such that the weld line created when the flowing material comes together is controlled to occur at one side or the other of the transverse midpoint of the blade 12. Since the weld line is the weakest point in the structure it is desirable to avoid its occurance toward the center of the blade where the pressure is greatest in the use of the trowel. Furthermore, the secondary ridges 18, being relatively smaller than primary ridge 16, cure more quickly and tend to support the latter during its longer curing time.

Longitudinal reinforcing ribs 20 are formed in the upper surface of blade 12 to provide even greater strength over the length of the blade 12 particularly at the corners. Additional ridges 22 and 24 are formed in the upper surface of blade 12 around the edge of the recess into which the rigid insert plate 14 is secured, as will be more fully described below.

Figure 2:
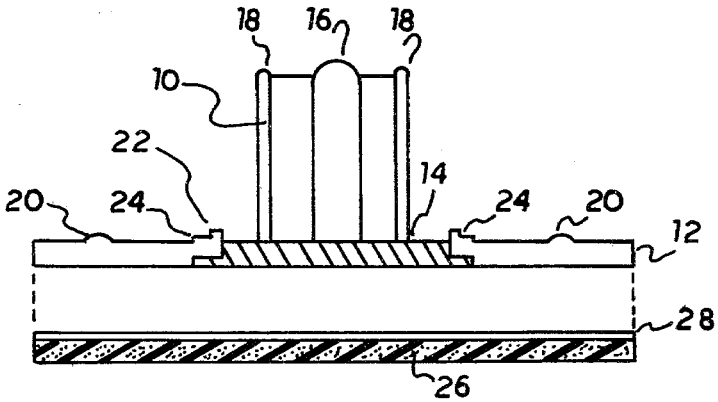
FIG. 2 is an end view of the apparatus of FIG. 1 including a grouting pad.

FIG. 2 is an end view primarily in elevation but partially in cross section of the apparatus of FIG. 1 wherein like features are identified by like reference characters. In this view the configuration of the rigid insert plate 14 is more clearly shown secured by any convenient means (e.g. an adhesive, solvent or heating) such that its lower surface is flush with that of blade 12. The ridges 22 and 24 serve to reinforce the blade 12 around the recess required to accomodate the insert plate 14.

The apparatus of FIGS. 1 and 2 may easily be adapted for use as a float for applying grouting to tile. A sponge or rubber pad 26 such as closed cell polyethylene or neoprene of substantially the same dimensions as the blade 12 is fixed to the lower surface thereof. Pads having an adhesive layer 28 may easily be attached and removed without affecting the utility of the apparatus as a trowel.

Figure 3:
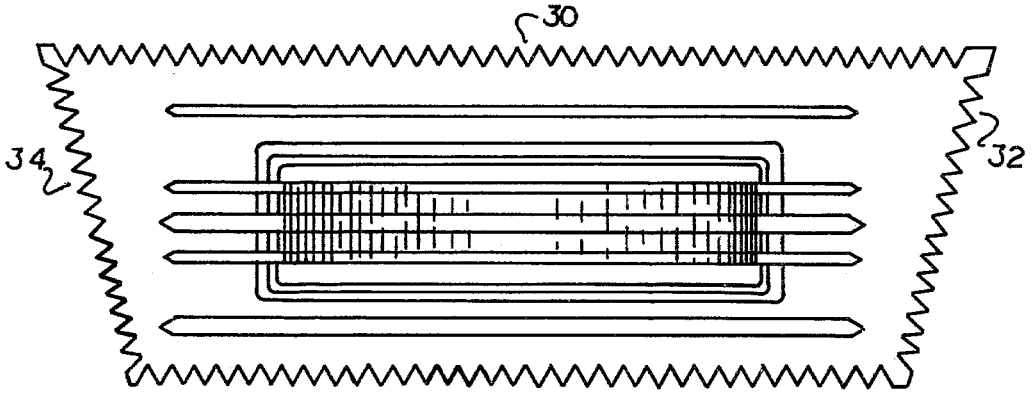
FIG. 3 is a top view of an adhesive trowel in accordance with the principles of the present invention.

FIG. 3 illustrates an embodiment of the present invention adapted for use as a notched trowel for spreading adhesives. Elements common to those shown in FIGS. 1 and 2 are identified by like reference characters. In this embodiment the blade 12 is formed in a trapezoidal configuration having each of its edges serrated. A triangular notch serration 30 is illustrated, however, any other type of serration (e.g. square, rectangular, half-round or combinations thereof) may be used which is appropriate to the type of adhesive to be spread. The ends 32 and 34 of the blade 12 are beveled at any preselected angle to achieve the overall trapezoidal shape. Through experience the applicant has found that an angle of between eight and twelve degrees is appropriate for most applications but not critical. Due to this configuration it will be seen that the trowel is usable with both the right and left hand thus avoiding the need for separate models as in the prior art. Although the trowel may of course be of any desired dimensions the Applicant has found it convenient to make the tapered ends 32 and 34 the same length as the size of the tile being installed and the shorter of the two sides twice the length of the ends; e.g. 4¼" ends and 8½" side for applying adhesive for typical wall tile.

Figure 4:
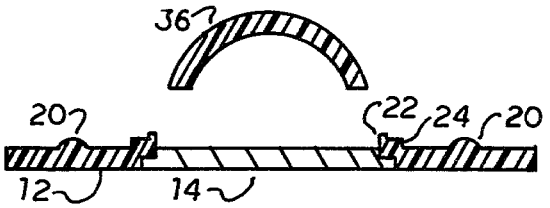
FIG. 4 is a transverse cross-section view of an alternative embodiment of the present invention.

FIG. 4 illustrates in transverse cross section an alternative configuration of the arcuate handle 36 wherein the requirement for reinforcing ridges is obviated. The compound arc configuration in both the longitudinal and transverse dimensions provides sufficient strength to accomodate the downward pressure in use. While this type of handle could be completely tubular, for the purposes of injection molding an open configuration having rounded edges is more convenient.

Figure 5:
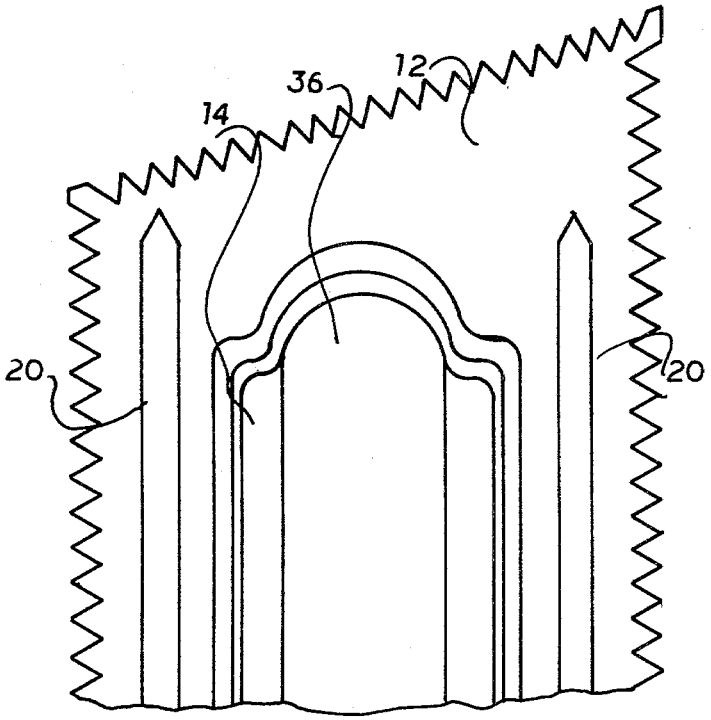
FIG. 5 is a partial top view of the apparatus of FIG. 4.

FIG. 5 is a partial top elevation view showing the disposition of the reinforcing ridges 22 and 24 when the trowel is formed with the handle configuration of FIG. 4.

From the foregoing it will be understood that the applicant has provided a very simple and economical hand trowel. Since certain changes in the above-described construction will occur to those skilled in the art without departure from the scope of the invention it is intended that all matter contained in the above description or shown in the appended drawings shall be interpreted as illustrative and not in a limiting sense.

Having described what is new and novel and desired to secure by Letters Patent, what is claimed is:

1. A hand trowel comprising
a blade portion having a substantially flat lower surface and four edges; and
a longitudinally arcuate handle portion integrally formed at its ends with the upper surface of said blade portion, extending outwardly from said upper surface, and having a first reinforcing ridge integrally formed therein substantially along the longitudinal centerline thereof and extending onto the upper surface of said blade portion.

2. A hand trowel as recited in claim 1 wherein
said blade portion is of rectangular shape; and
said handle portion is disposed along a longitudinal axis of said blade portion.

3. A hand trowel as recited in claim 2 further including
a closed cell pad of substantially the same dimensions as said blade portion affixed to the lower surface of said blade portion.

4. A hand trowel as recited in claim 1 wherein
said blade portion is elongate trapezoidal shape; and
said handle portion is disposed substantially along the longitudinal centerline of said blade portion.

5. A hand trowel as recited in claim 4 wherein
the outer edges of said blade portion are serrated in a predetermined pattern.

6. A hand trowel as recited in claim 1 further including
second and third reinforcing ridges integrally formed with said handle portion, one disposed at each longitudinal edge of said handle portion and extending onto the upper surface of said blade portion.

7. A hand trowel as recited in claim 1 wherein
said blade portion is provided with a substantially rectangular, centrally disposed opening therethrough, the inner edges of said opening being recessed a preselected depth into the lower surface of said blade portion, and a substantially rigid insert plate being affixed in said recessed opening such as to be flush with the lower surface of said blade portion.

8. A hand trowel as recited in claim 7 further including
a reinforcing ridge integrally formed with the upper surface of said blade portion about the edges of said opening.

9. A hand trowel as recited in claim 1 wherein
said handle portion is of an arcuate configuration in both longitudinal and transverse dimensions.

* * * * *